US005192936A

United States Patent [19]

Neff et al.

[11] Patent Number: 5,192,936

[45] Date of Patent: Mar. 9, 1993

[54] SOLENOID

[75] Inventors: James A. Neff, Birmingham; Richard A. Fagerlie, West Bloomfield; Eric P. Janssen, Howell; Michael E. Robert, Union Lake, all of Mich.

[73] Assignee: Mac Valves, Inc., Wixom, Mich.

[21] Appl. No.: 748,457

[22] Filed: Aug. 22, 1991

[51] Int. Cl.[5] ..... H01F 3/00; H01F 7/08

[52] U.S. Cl. ..... 335/281; 335/263; 335/278; 335/279

[58] Field of Search ..... 335/148, 149, 150, 222, 335/223, 224, 225, 226, 238, 249, 251, 255, 256, 257, 258, 259, 260, 261, 262, 263, 264, 266, 267, 268, 270, 271, 273, 274, 277, 278, 279, 281, 282; 310/23, 22, 24, 30, 34, 35

*Primary Examiner*—Leo P. Picard
*Assistant Examiner*—Raymond Barrera
*Attorney, Agent, or Firm*—Robert G. Mentag

[57] ABSTRACT

A solenoid having a bobbin with a rectangular core hole in which is mounted an armature having a rectangular cross section, and a pole piece having a rectangular cross section. The bobbin has a magnet wire coil wound around a bobbin tubular body which is rectangular in cross section. The bobbin has an upper flange and a lower flange that encloses the ends of the coil. A tubular can is seated around the bobbin. A top flux plate is seated on the upper can surface and a bottom flux plate is seated under the lower can surface. The flux plates are secured to the bobbin flanges. A sealing, electrical insulating heat dissipating material is disposed inside of the tubular can which seals the coil and insulates the coil from the flux plates, tubular can and solenoid mounting screws.

7 Claims, 2 Drawing Sheets

SOLENOID

BACKGROUND OF THE INVENTION

1. Field of the Invention

The field of art to which this invention pertains may be generally located in the class of devices relating to valves. Class 335, Electricity, Magnetically Operated Switches, United States Patent Office Classification, appears to be the applicable general area of art to which the subject matter similar to this invention has been classified in the past.

2. Description of the Prior Art

This invention relates to solenoids, and more particularly to solenoids adapted for use in operating miniature valves or like members. Heretofore, the prior art solenoids incorporated a round core iron construction comprising a cylindrical armature and a mating cylindrical pole piece. The disadvantage of such prior art solenoids is that the width of a solenoid with a round core iron construction is substantially increased to produce a solenoid with a given force at a given stroke. In miniature valve packages, the width of the valve and solenoid is of primary bottom flux plate which engages the lower end of the can. The upper end of the can is closed off with a flux carrying top plate, and the can is secured between the top and bottom flux plates by any suitable means, such as heat forming the flux plates to the bobbin flanges. An armature bushing is slidably mounted into the upper end of the bobbin, and it is rectangular in cross section, with rounded ends, so as to slidably fit within the similarly shaped cored hole in the bobbin. An elongated armature having a rectangular cross section, with rounded ends, is slidably mounted in the armature bushing. The inner end of the armature is engaged by a push pin which is slidably mounted through an axial bore formed through the pole piece. A top cover member is mounted on the top flux plate securing the aforementioned solenoid assembly to the valves or similar device.

The upper and lower ends of the armature are provided with a radially shaped end surface to insure the solenoid shifts fully even if the armature is cocked slightly when the solenoid is energized. The rectangular shape of the coil bobbin not only increases the ampere turns of the coil, but also increases the cross-sectional and surface areas of the armature and pole piece which turns the increased ampere turns into increases force.

DESCRIPTION OF THE PREFERRED EMBODIMENT

Figure 1:
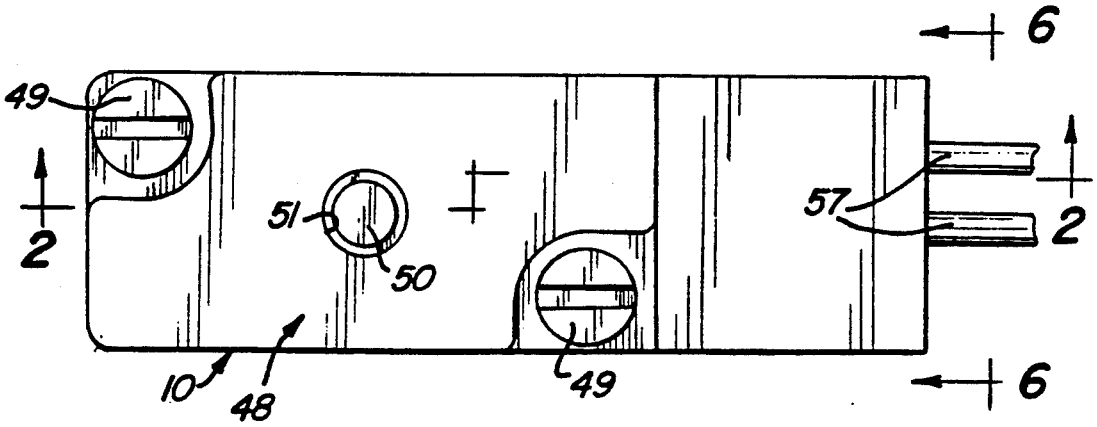
FIG. 1 is a top plan view of a solenoid made in accordance with the principles of the present invention.
Figure 2:
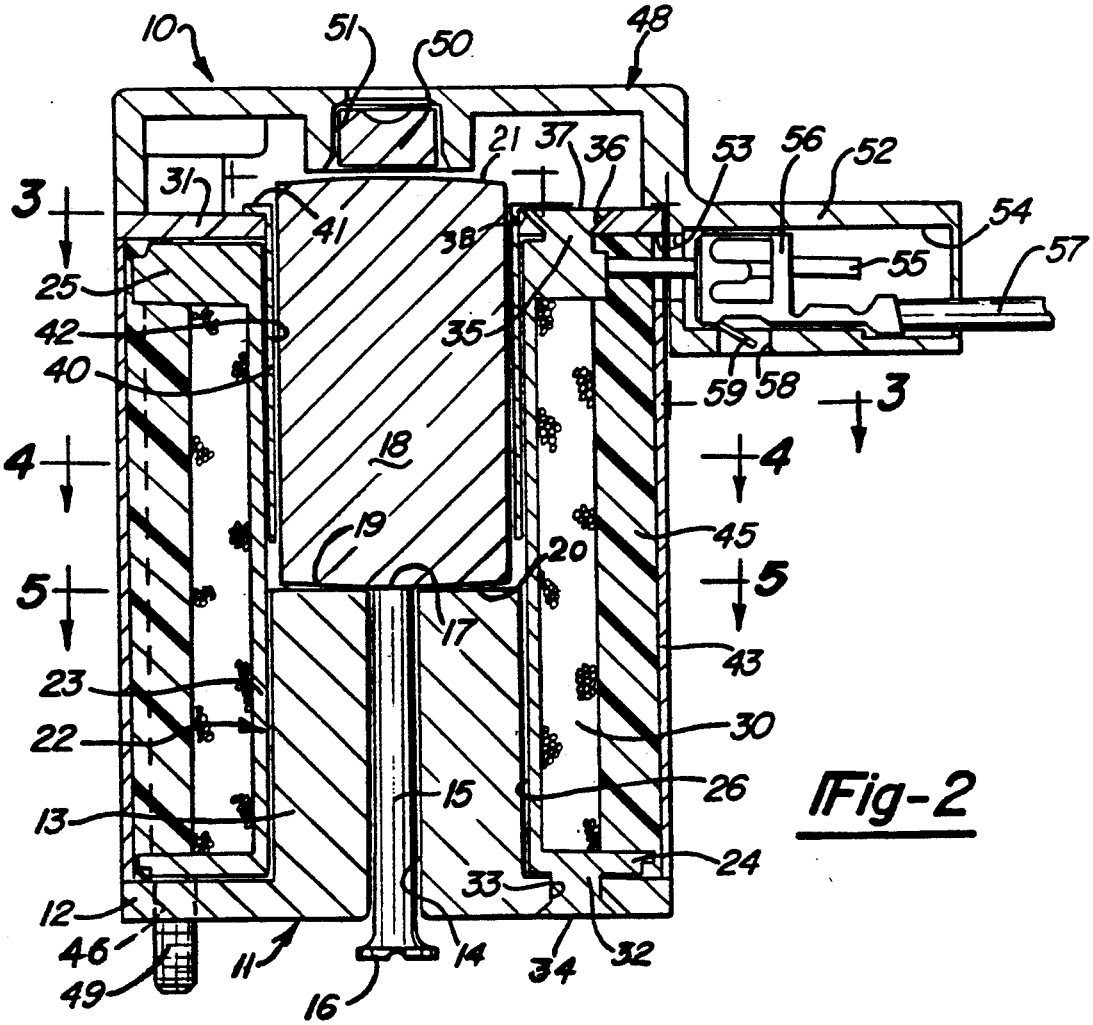
FIG. 2 is an elevation section view of the solenoid shown in FIG. 1, taken along the line 2—2 thereof, and looking in the direction of the arrows

Referring now to the drawings, and in particular to FIGS. 1 and 2, the numeral 10 generally designates a solenoid made in accordance with the principles of the present invention. As shown in FIG. 2, the numeral 11 generally designates a pole piece that has a substantially T-shaped vertical cross section, and which comprises a bottom transverse flux plate 12 and an integral pole plate 13. An axial bore 14 is formed through the pole piece 11 for the slidable reception of a conventional push pin 15. The push pin 15 has an enlarged head 16 for operative engagement with the valve spool of a valve or other mechanism to be actuated by the solenoid 10. The numeral 17 designates the inner end of the push pin 15 and it operatively engages the radially shaped lower end 20 of an armature 18 which is made from a suitable magnetic material, such as a powdered metal. The numeral 19 designates the upper end of the pole piece 11. The numeral 21 designates the radially shaped upper end of the armature 18.

Figure 3:
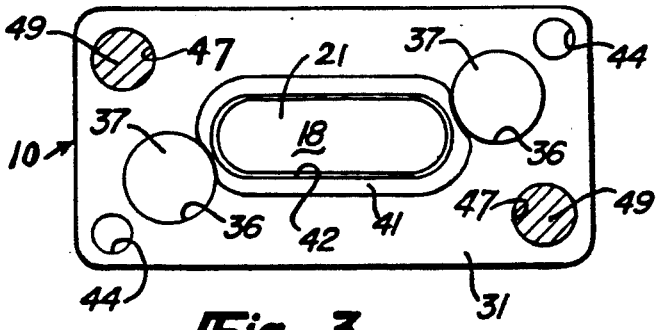
FIG. 3 is a horizontal view, with parts removed, o the solenoid illustrated in FIG. 2, taken along the line 3—3 thereof, and looking in the direction of the arrows.
Figure 4:
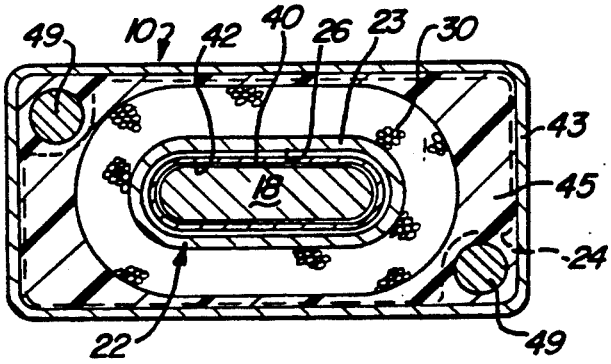
FIG. 4 is a horizontal section view of the solenoid illustrated in FIG. 2, taken along the line 4—4 thereof, and looking in the direction of the arrows.
Figure 5:
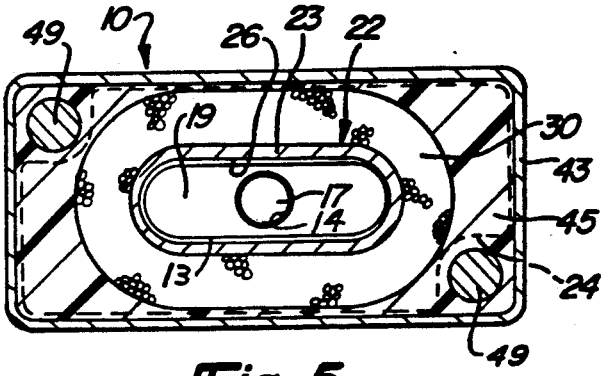
FIG. 5 is a horizontal section view of the solenoid illustrated in FIG. 2, taken along the line 5—5 thereof, and looking in the direction of the arrows.

As shown in FIG. 2, the solenoid 10 includes a coil bobbin, generally indicated by the numeral 22, and which comprises an elongated tubular body 23, an integral lower transverse flange 24, and an integral upper transverse flange 25. As shown in FIGS. 4 and 5, the coil bobbin body 23 is formed with a rectangular cross section, with rounded ends. An axial cored hole 26 is formed through the coil bobbin body 23, and it also is rectangularly shaped, with rounded ends. As shown in FIGS. 2, 4 and 5, the numeral 30 designates a wire coil which is formed around the bobbin tubular body 23, by winding therearound, in a conventional manner a fine magnetic wire. The bobbin 22 is made from a suitable plastic material. As shown in FIGS. 2 and 3, the solenoid 10 includes a top flux plate 31 that is seated on top of the bobbin upper flange 25, and which is provided with a rectangular opening 38 (FIG. 2), with rounded ends.

As shown in the FIG. 2, the bottom flux plate 12 is provided with at least two holes, as shown by the hole 33 which have countersunk outer ends. The bobbin lower flange 24 has an equal number of integral extensions 32, which extend axially and outwardly through the bottom flux plate holes 33. The upper bobbin flange 25 is also provided with at least a pair of extensions 35 which extend axially and importance. The length and height are important, but they are not as critical as the width. At the present time, there is a need for small, compact and efficient solenoids, which may be made to a very narrow size, for use in control circuits for operating industrial manufacturing and assembly equipment.

THE SUMMARY OF THE INVENTION

It is an object of the invention to provide a solenoid which is small, compact, efficient and powerful, and which overcomes the aforementioned disadvantages and problems of the prior art solenoids. A solenoid made in accordance with the present invention includes a bobbin having an outer surface which is rectangular in cross section and with rounded ends, and having a similarly shaped cored hole. The bobbin has an integral upper flange and an integral lower flange. A solenoid magnetic wire coil, is wound around the bobbin to provide a solenoid coil having a rectangular cross section with rounded ends, which provides an increased length of coil wire for each turn of the wire, which results in an increased electrical resistance per turn, which increases the ampere turns of the coil, and which increases the force of the solenoid. The bobbin is telescopically mounted into a tubular shell that is rectangular in cross section and open at both ends, and which is hereinafter called a can. The can is a thin-walled flux carrying member. A pole piece having a rectangular cross section, with rounded ends is slidably mounted in the lower end of the bobbin rectangular cored hole. The pole piece is provided with an integral outwardly through holes 36 formed through the top flux plate 31. A thin-walled, open ended shell or can 43 is mounted over the aforedescribed bobbin and wire coil assembly. The pole piece structure 11 and top flux plate 31 are assembled to their respective bobbin flanges, and secured by heat forming the bobbin flange extensions (32,35) flat and flush (34,37) with the outer surfaces of their respective flux plates.

A bushing 40 is slidably mounted through the opening 38 in the top flux plate 31 and down into the cored hole 26 in the bobbin body 23. The bushing 40 has a flange 41 formed around the top end thereof and it seats around the opening 38 in the top flux plate 31. The armature 18 is slidably mounted in the armature bushing 40. The armature bushing 40 is made from any suitable magnetic material, as from cold rolled steel, and it guides the armature 18 in its operative movements and conducts flux from the top flux plate 31 into the armature 18. As best seen in FIG. 3, the armature bushing 40 has an inner periphery 42 formed therethrough which is rectangular and has rounded ends.

As shown in FIGS. 2, 4 and 5, the internal space between the coil 30 and the can 43 is filled with a suitable potting or encapsulant material 45 which is an electrical insulator and sealant to protect the coil 30 from moisture, and to provide a better transfer material for heat in that internal area of the solenoid, instead of air. As shown in FIG. 3, two holes 44 are provided in the top flux plate 31 for the injection of the potting material 45. The solenoid assembly is placed in a fixture with suitable pins extending through the entire assembly, so that the potting material 45 may be inserted into the can 43 and permit the potting material 45 to flow around the pins to provide holes for the screws 49.

Figure 6:
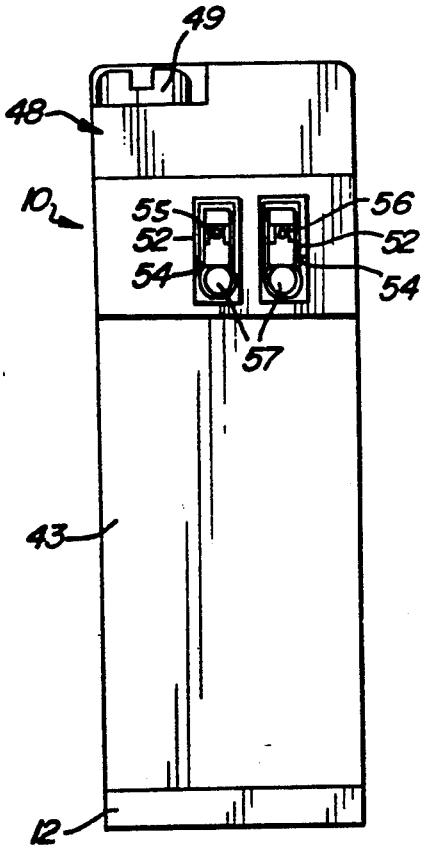
FIG. 6 is right side elevation view of the solenoid illustrated in FIG. 1, taken along the line 6—6 thereof, and looking in the direction of the arrows.

As shown in FIGS. 1 and 6, a top end cover, generally indicated by the numeral 48, is releasably secured to the aforedescribed solenoid structure by a pair of suitable elongated screws 49 which extend downwardly through holes (not shown) in the top cover 48 and through holes 47 (FIG. 3) in the top flux plate 31 and then downwardly through suitable holes (not shown) in the bobbin upper flange 25 and the bobbin lower flange 24, and holes 46 in the bottom flux plate 12, and into threaded engagement with threaded holes in a valve body or device to be operated.

A suitable encapsulant material is a silicone compound. As shown in FIG. 2, the solenoid 10 is provided with a manual operator 50 which is mounted in a stepped hole 51 that is formed in an axial position in the top end cover 48. As shown in FIG. 6, the top end cover 48 carries a pair of integral, sidewardly extended electrical conductor conduits 52. The conduits 52 are spaced apart and are open at the outer ends thereof. The interiors 54 of the conduits 52 communicate through a pair of mating holes 53 (FIG. 2) formed through the inner end of each conduit 52 and through the can 43. A conductor post 55 is disposed in each conduit 52 which is operatively connected to the coil 30. Operatively mounted on each of the conductor posts 55 is a receptacle connector 56 (FIG. 2) which in turn is operatively connected to a lead wire 57. The receptacle connectors 56 are releasably secured in position on the posts 55 by a detent member 59. The detent members 59 are spring arms that are flexed downwardly into detent holes 58 in the bottom wall of each of the conduits 52.

The solenoid 10 may be employed as a straight DC solenoid when using the top end cover 48, or it may be used as a rectified AC solenoid by employing conventional AC conversion means. The elongated and narrow construction of the rectangularly shaped solenoid 10 provides advantages over the prior art solenoids having a round iron core construction. The solenoid 10 may be used in instances where only a narrow space is available for mounting a solenoid. For example, a solenoid 10 can be made to a very small width, as for example, a 10 millimeter width, for use where space restrictions do not permit the use of a wider solenoid. The rectangular cross section of the core area of the solenoid 10 provides a solenoid construction wherein the cross-sectional and surface areas of the core iron is optimized and the perimeter of the bobbin body 23, around which the magnet wire for the coil 30 is wound, is lengthened as compared to the perimeter of a circular solenoid bobbin body, so that electrical resistance of the coil 30 is increased to obtain the optimum number of ampere turns. With this coil structure there is a substantial increase in the amount of magnetic force that can be produced with the coil 30 so as to provide a very efficient low wattage and short stroke solenoid. The fact that the can 43 goes all around the coil 30 and is thin in cross section provides a more efficient solenoid. The aforedescribed structure of the solenoid 10 provides an efficient flux path, wherein the top flux plate 31 and the bottom flux plate 12 are held against the upper and lower ends of the can 43 to provide an efficient flux path through these members, the bushing 40, the pole piece 13, and the armature 18. The potting material 45 electrically insulates the coil from these inside and outside magnetic parts and the mounting screws 49. The radial surface on the lower and upper ends, 20 and 21, respectively, of the armature 18 are flat and curved along the long axis of the ends of the rectangularly shaped armature 18.

What is claimed is:

1. A solenoid (10) having a bobbin (22) and a coil (30) wound thereon, the bobbin (22) having a core hole (26) with an armature bushing (40) mounted therein, an armature (18) and pole piece (13) operatively mounted in the core hole (26), characterized in that:

(a) the bobbin (22) has a tubular body which forms a core hole (26) that is rectangular in cross section and has an upper end and a lower end;

(b) the armature bushing (40) is mounted in the upper end of the bobbin core hole (26) and it is rectangular in cross section;

(c) the armature (18) is movably mounted in the armature bushing (40) and it is in cross section;

(d) the pole piece (13) is fixedly mounted in the lower end of the bobbin core hole (26) and it is rectangular in cross section;

(e) the bobbin (22) is provided with an integral upper flange (25) and an integral lower flange (24) which enclose the upper and lower ends of the coil (30);

(f) a top flux plate (31) is mounted on the upper bobbin flange (25) and it has an axial hole formed therethrough which is rectangular in cross section and through which the armature bushing (40) is mounted;

(g) a bottom flux plate (12) is integral with the pole piece (13) and extends beneath the bobbin lower flange (24);

(h) a tubular can (43) having top and bottom open ends and a rectangular cross section is mounted around the coil (30), and it is held in contact, with and between, the top (31) and bottom (12) flux plates;

(i) fastening means (32,35) for securing the top (31) and bottom (12) flux plates to the bobbin flanges to hold the bobbin (22), flux plates (31,12) and tubular can (43) together; and, (j) a sealing, electrically insulating and heat conducting encapsulant material is disposed within the tubular can (43) and surrounds the coil (30); and, (k) the solenoid (10) includes a detachably mounted top end cover (48).

2. A solenoid (10) as defined in claim 1, characterized in that:

(a) said top end cover (48) includes an electrical connection means (52–59) for operatively connecting the coil (30) to lead wires (57).

3. A solenoid (10) as defined in claim 1, characterized in that:

(a) the rectangular bobbin core hole (26), armature bushing (40), armature (18) and pole piece (13) have rounded ends.

4. A solenoid (10) as defined in claim 3, characterized in that:

(a) at least the bottom end (20) of the armature (18) is formed with a radial surface to compensate for cocking of the armature (18) when the solenoid (10) is energized.

5. A method of making a solenoid (10), including the steps of:

(a) providing a bobbin (10) having a tubular body with an outer surface which is rectangular in cross section and having a similarly shaped core hole (26) having an upper end and a lower end, and which bobbin tubular body is provided with an integral upper flange (25) and an integral lower flange (24);

(b) winding magnetic wire around the rectangular outer surface of the bobbin (22) to provide a solenoid coil (30) having a rectangular cross section;

(c) mounting a pole piece (13) having a rectangular cross section in the lower end of the core hole (26), which pole piece has an integral bottom flux plate (12);

(d) mounting a tubular can (43) having a rectangular cross section over the bobbin (22) and seating the lower end thereof on the bottom flux plate (12);

(e) mounting a top flux plate (31) having an axial rectangular opening on the bobbin upper flange (25) and in contact with the upper end of the tubular can (43);

(f) fixedly securing the bottom flux plate (12) to the bobbin lower flange (24) and the top flux plate (31) to the bobbin upper flange (25) to securely hold the tubular can (43) between the top flux plate (31) and the bottom flux plate (12);

(g) slidably mounting an armature bushing (40) having a rectangular cross section through the rectangular opening in the top flux plate (31) and into the upper end of the core hole (26);

(h) slidably mounting an armature (18) through the rectangular opening in the top flux plate (31) and into the rectangular armature bushing (40); and, (i) injecting a sealing, electrical insulating and heat dissipating encapsulating material (45) into the tubular can (43) to seal and electrically insulate the solenoid coil (30) from the top and bottom flux plates (31,12) and the tubular can (43) and any solenoid mounting screws (49) used to mount the solenoid on a device to be operated.

6. The method of making a solenoid (10) as defined in claim 5, including the step of:

(a) providing the rectangular openings in the top (31) and bottom flux plates (12), the armature bushing (40), and the core hole (26) with rounded ends.

7. The method of making solenoid as defined in claim 5, including the step of:

(a) providing at least the bottom end (20) of the armature (18) with a radial surface.

* * * * *

UNITED STATES PATENT AND TRADEMARK OFFICE
CERTIFICATE OF CORRECTION

PATENT NO. : 5,192,936

DATED : March 9, 1993

INVENTOR(S) : James A. Neff, et al

It is certified that error appears in the above-identified patent and that said Letters Patent is hereby corrected as shown below:

Column 1, line 24, after "is of primary" insert the following:

-- importance. The length and height are important, but they are not as critical as the width. At the present time, there is a need for small, compact and efficient solenoids, which may be made to a very narrow size, for use in control circuits for operating industrial manufacturing and assembly equipment.

THE SUMMARY OF THE INVENTION

It is an object of the invention to provide a solenoid which is small, compact, efficient and powerful, and which overcomes the aforementioned disadvantages and problems of the prior art solenoids. A solenoid made in accordance with the present invention includes a bobbin having an outer surface which is rectangular in cross section and with rounded ends, and having a similarly shaped cored hole. The bobbin has an integral upper flange and an integral lower flange. A solenoid magnetic wire coil, is wound around the bobbin to provide a solenoid coil having a rectangular cross section

UNITED STATES PATENT AND TRADEMARK OFFICE
CERTIFICATE OF CORRECTION

PATENT NO. : 5,192,936

DATED : March 9, 1993

INVENTOR(S) : James A. Neff, et al

It is certified that error appears in the above-identified patent and that said Letters Patent is hereby corrected as shown below:

with rounded ends, which provides an increased length of coil wire for each turn of the wire, which results in an increased electrical resistance per turn, which increases the ampere turns of the coil, and which increases the force of the solenoid. The bobbin is telescopically mounted into a tubular shell that is rectangular in cross section and open at both ends, and which is hereinafter called a can. The can is a thin-walled flux carrying member. A pole piece having a rectangular cross section, with rounded ends is slidably mounted in the lower end of the bobbin rectangular cored hole. The pole piece is provided with an integral --

Column 2, delete lines 48-68, begining with "importance. The length ....." and ending with "which results in an".

Column 3, delete lines 1-10, begining with "increased electrical....." and ending with "piece is provided with an integral".

UNITED STATES PATENT AND TRADEMARK OFFICE

CERTIFICATE OF CORRECTION

PATENT NO. : 5,192,936

DATED : March 9, 1993

INVENTOR(S) : James A. Neff, et al

It is certified that error appears in the above-identified patent and that said Letters Patent is hereby corrected as shown below:

Column 4, claim 1, line 59, element (c), between "is" and "in" insert --rectangular--.

Signed and Sealed this

Twenty-third Day of November, 1993

*Attest:*

*Attesting Officer*

Bruce Lehman

BRUCE LEHMAN

*Commissioner of Patents and Trademarks*